United States Patent [19]

Saito et al.

[11] Patent Number: 4,466,475

[45] Date of Patent: Aug. 21, 1984

[54] DEVICE FOR DRIVING AND STOPPING A ROLL BLIND

[75] Inventors: Yasuji Saito; Hiroomi Yamanaka, both of Chiba, Japan

[73] Assignee: Kabushiki Kaisha Nichibei, Tokyo, Japan

[21] Appl. No.: 439,556

[22] Filed: Nov. 5, 1982

[30] Foreign Application Priority Data

Nov. 16, 1981 [JP] Japan ..... 56-171294
Apr. 16, 1982 [JP] Japan ..... 57-55710
Oct. 15, 1982 [JP] Japan ..... 57-155839

[51] Int. Cl.[3] ..... E06B 9/208
[52] U.S. Cl. ..... 160/297
[58] Field of Search ..... 160/302, 305, 296, 297, 160/311, 298

[56] References Cited

U.S. PATENT DOCUMENTS 1,497,849 6/1924 Hart ..... 160/302
4,009,745 3/1977 Erpenbeck ..... 160/297
4,250,942 2/1981 Dreher ..... 160/297

FOREIGN PATENT DOCUMENTS 265289 1/1965 Australia ..... 160/297

*Primary Examiner*—Peter M. Caun
*Assistant Examiner*—Cherney S. Lieberman
*Attorney, Agent, or Firm*—Toren, McGeady and Stanger

[57] ABSTRACT

A device for driving and stopping a roll blind including a blind cloth and a winding roll for winding up and unwinding the blind coth, which includes a clutch mechanism which is actuated to its ON- and OFF-positions by drawing the blind cloth downward. In the cloth lowering operation the clutch mechanism is held in ON-position in order to stop the blind cloth at a desired position and in the cloth raising operation the clutch mechanism is actuated to the OFF-position by slightly drawing the blind cloth downward, thereby allowing the blind cloth onto the winding roll.

3 Claims, 7 Drawing Figures

DEVICE FOR DRIVING AND STOPPING A ROLL BLIND

BACKGROUND OF THE INVENTION

The present invention relates to a device for driving and stopping a roll blind.

A roll blind consists of a blind cloth and a winding roll for winding up or unwinding said blind cloth. A device for driving and stopping the roll blind, heretofore used, comprises a coil spring for constantly applying a force to said winding roll in the cloth winding up direction and a ratchet mechanism for stopping said winding roll against the force applied by said coil spring to stop the blind cloth at a desired position, in which at the time of lowering the blind cloth the ratchet mechanism is actuated under centrifugal force to stop the blind cloth at the desired position and at the time of raising said blind cloth the ratchet mechanism is released by slightly moving the blind cloth downward, whereby the blind cloth is allowed to be wound up onto the winding roll under the action of said coil spring.

The conventional device for driving and stopping the roll blind, as described above, requires troublesome operation to correctly stop the blind cloth at a desired position, and consequently it is difficult to correctly stop the blind cloth at a desired height. Furthermore, it is difficult to wind the blind cloth smoothly onto the winding roll.

SUMMARY OF THE INVENTION

It is an object of the present invention to provide a device for driving and stopping a roll blind in which a simple clutch mechanism is used in place of the ratchet mechanism as described above, in order to correctly stop the blind cloth at a desired position.

It is another object of the present invention to provide a device for driving and stopping a roll blind in which a blind cloth can be wound up smoothly onto a winding roll.

The present invention provides a device for driving and stopping a roll blind including a blind cloth and a cloth winding roll for winding up or unwinding said blind cloth, said cloth winding roll having a coil spring for constantly applying rotating force to the cloth winding roll in cloth winding up direction and means for stopping said winding roll against the action of said coil spring to stop the blind cloth at a desired height, which comprises a clutch drum supporting member fixedly mounted in said winding roll in coaxial relation therewith, a clutch drum loosely fitted in said supporting member in coaxial relation therewith and rotatably supported at its one end on one of roll blind supporting brackets so that it can rotate at a predetermined angle relatively to said bracket, a connecting member movably mounted in said clutch drum to project from said clutch drum to connect the supporting member with said clutch drum and retract into said clutch drum to disconnect the supporting member from the clutch drum, and a clutch mechanism for retracting said connecting member into the clutch drum to allow free rotation of said winding roll when the blind cloth is lowered, then projecting said connecting member from the clutch drum when the lowering movement of the blind cloth is stopped and retracting said connecting member into the clutch drum again when the blind cloth is slightly moved downward from said stopped position.

In one form, the clutch mechanism comprises a clutch shaft rotatably mounted in said clutch drum for rotation to right and left at a predetermined angle to move said connecting member to projected or retracted position, a first clutch wheel integrally formed on said clutch shaft, a second clutch wheel loosely fitted on said clutch shaft for axial movement relatively to said clutch drum and a spring for resiliently urging these clutch wheels together, said first clutch wheel and said one of roll blind supporting brackets being formed on their contacting surfaces with a number of clutch dogs which only allow the rotation of the first clutch wheel in the cloth lowering direction, said first clutch wheel and said second clutch wheel being formed on their contacting surfaces with the same number of clutch dogs which only allow the transmission of the rotation of the second clutch wheel in said direction to the first clutch wheel. A speed reducing device is arranged between the clutch drum and the winding roll.

In another form of the present invention, an oil damper device is arranged between the winding roll and a center shaft for supporting said winding roll to allow the blind cloth to be wound up onto the winding roll in a reliable and smooth manner.

In the roll blind driving and stopping device according to the present invention, the blind cloth can be manually lowered to a desired position and is stopped at said desired position by discontinuing the lowering operation and releasing the blind cloth, and then the blind cloth can be moved upward by slightly moving the blind cloth downward to release the stopping mechanism.

Now the present invention will be explained with reference to the accompanying drawings.

DESCRIPTION OF THE PREFERRED EMBODIMENTS

Figure 1:
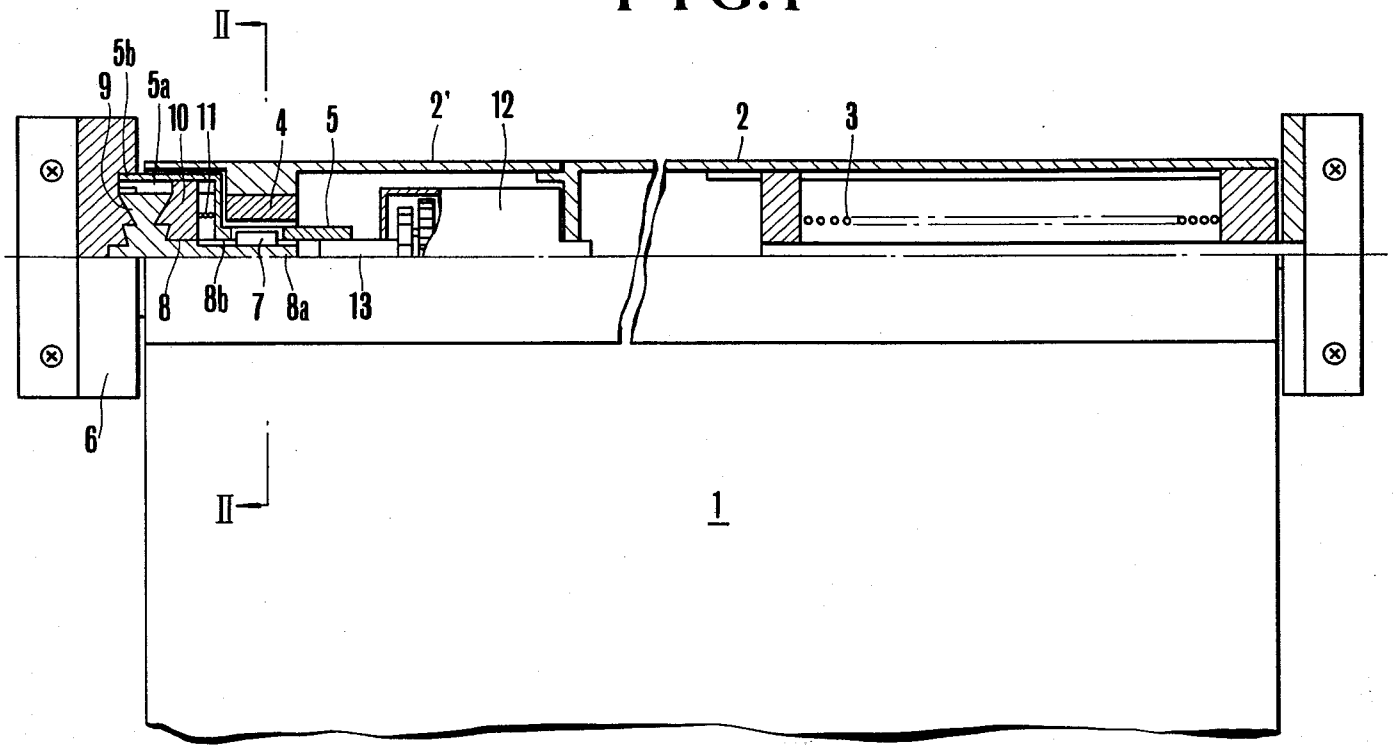
FIG. 1 is a longitudinal section showing one embodiment of the device according to the present invention.
Figures 2, 3:
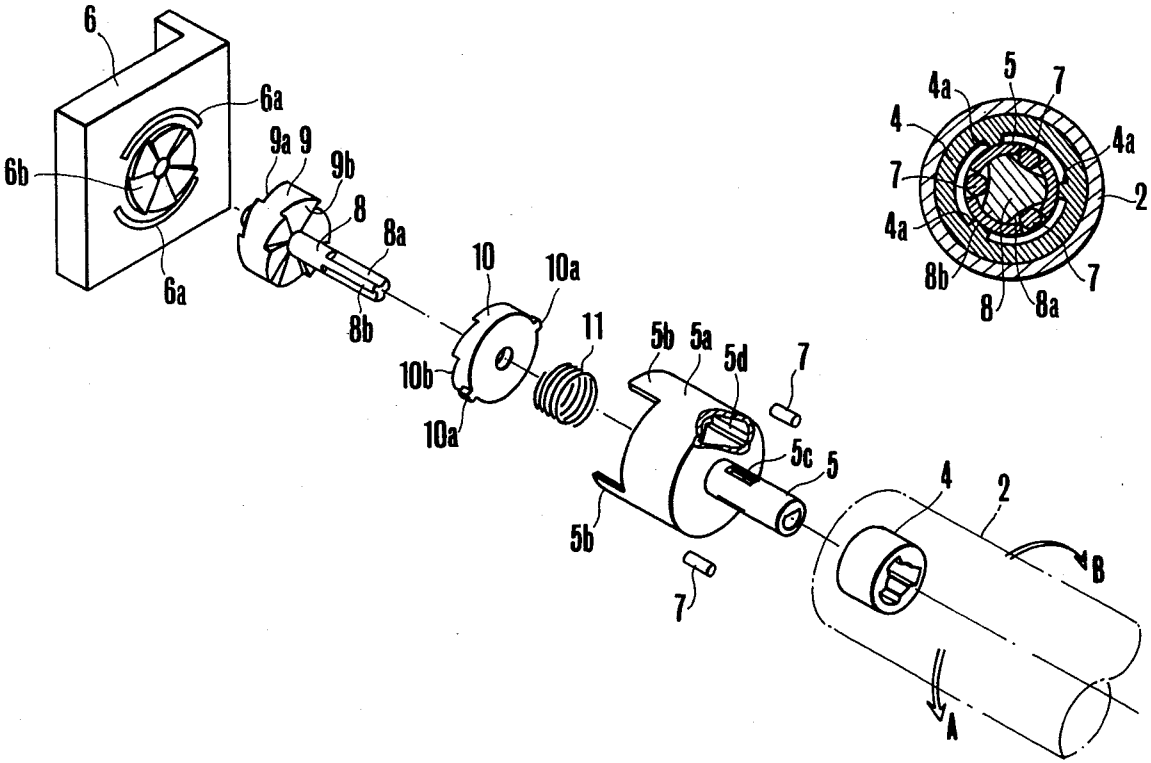
FIG. 2 is a cross section taken along the line II—II in FIG. 1.
FIG. 3 is an exploded perspective view of the device shown in FIG. 1.

FIGS. 1 to 3 illustrate an embodiment of the present invention. The roll blind shown in FIG. 1 comprises a blind cloth 1, a winding roll 2 for winding up or unwinding said blind cloth and a coil spring 3 which constantly acts to rotate the winding roll in cloth winding up direction. The winding roll 2 has a tubular portion 2' fixed to one end of said roll, in which the device for driving and stopping the roll blind according to the present invention is housed.

The device according to the present invention comprises a clutch drum supporting member 4 fixedly mounted in said tubular portion 2' of the roll 2 in coaxial rotation therewith and a clutch drum 5 loosely fitted in said supporting member in coaxial relation therewith. The clutch drum 5 has a clutch frame 5*a* integrally formed therewith. The clutch frame has projections 5*b* which are arcuate shape in section, which engage in arcuate grooves 6*a* formed in a bracket 6 which supports one end of the roll blind, so that the clutch drum 5 is rotatable to a predetermined angle relatively to said bracket (see FIG. 3). The clutch drum 5 has slots 5*c* formed in the wall thereof, in which connecting members 7 are movably mounted so at to project from and retract into the clutch drum 5. In the retracted position of the connecting members 7, the clutch drum supporting member 4 and the clutch drum 5 are rotatable relatively to each other, while in the projected position the connecting members 7 come into engagement with ridges 4*a* projecting from the inside wall of said supporting member 4 so that the clutch drum 4 and the clutch drum supporting member 5 are rotated together.

A clutch mechanism is mounted in the clutch frame 5*a* of the clutch drum 5. This mechanism serves to retract said connecting members 7 into the clutch drum 5 to allow free rotation of said winding roll 2 when the blind cloth is manually lowered, then projected said connecting members 7 from the clutch drum 5 when the lowering movement of the blind cloth is stopped and retract said connecting members 7 into the clutch drum again when the blind cloth is slightly moved downward from said stopped position. The detailed construction of the clutch mechanism is shown in FIG. 3.

The clutch mechanism comprises a clutch shaft 8 rotatably mounted in the clutch drum 5 for rotation to right and left at a predetermined angle to move said connecting members 7 to their projected or retracted positions, a first clutch wheel 9 integrally formed on said clutch shaft 8, a second clutch wheel 10 loosely fitted on said clutch shaft for axial movement relative to said clutch frame 5*a*, and a spring 11 for resiliently urging said clutch wheels together.

Around the peripheral surface of said second clutch wheel 10 are formed projections 10*a*, which engage in grooves 5*d* formed in the inside surface of said clutch frame 5*a*, so that the second clutch wheel 10 is movable in axial direction relatively to the clutch frame 5*a* of the clutch drum 5, while the former is fixed in rotating direction relative to the latter, and said second clutch wheel is constantly urged against the first clutch wheel 9 under the action of said spring 11. The clutch shaft 8 has grooves 8*a* and ridges 8*b* formed thereon, which serve to cause the connecting members 7 to project from or retract into the clutch drum 5, depending on the rotation of said clutch shaft 8.

The first clutch wheel 9 and the bracket 6 are formed on their contacting surfaces with a number of clutch dogs 9*a* and 6*b*, respectively, which only allow the relation of the first clutch wheel 9 in the cloth lowering direction (shown by the arrow A in FIG. 3), and the first clutch wheel 9 and the second clutch wheel 10 are formed on their contacting surfaces with the same number of clutch dogs 9*b* and 10*b*, respectively, which only allow the transmission of the rotation of the second clutch wheel 10 in said cloth lowering direction to the first clutch wheel 9. A speed reducing device 12 (FIG. 1) is arranged between the clutch drum 5 and the winding roll 2. The speed reducing device has a center shaft 13 which is connected to the clutch drum 5.

Now the operation will be explained. It is assumed that the blind cloth 1 is wound up on the winding roll 2. If the blind cloth is drawn downward, the roll 2 is rotated in the direction indicated by the arrow A in FIG. 3. The clutch drum supporting member 4 fixedly connected to the roll 2 and the speed reducing device 12 are rotated in the direction A, so that the clutch drum 5 connected to the center shaft 13 is rotated in the direction A.

Thus the blind cloth is lowered. When the blind cloth is continuously drawn downward, the first clutch wheel 9 is rotated by the second clutch wheel 10 in the direction A by an angle corresponding to one of the clutch dogs 6*b* formed on the bracket 6, while the first clutch wheel 9 and the second clutch wheel 10 are held in engagement with each other, so that the relative position of the clutch shaft 8 and the clutch drum 5 is not changed and the connecting members 7 are held in their retracted positions. Thus the blind cloth can be drawn downward to a desired position.

When the lowering movement of the blind cloth is stopped, the winding roll 2, the clutch drum supporting member 4 and the speed reducing device 12 are rotated in the direction indicated by the arrow B in FIG. 3 under the action of the coil spring 3 arranged at the other end of the winding roll 2.

When the winding roll 2 is rotated in the direction B, the first clutch wheel 9 is prevented from rotating in said direction owing to the engagement of the dogs 6*b* formed on the bracket 6 with the dogs 9*a* formed on the first clutch wheel 9, while the second clutch wheel 10 is rotated in the direction B by the center shaft 13 connected to the speed reducing device 12. Thus the clutch frame 5*a* is rotated, and the second clutch wheel 10 connected thereto is rotated in the direction B by an angle corresponding to one of the clutch dogs. By the rotation of the second clutch wheel 10, the ridges 8*b* of the clutch shaft 8 serves to project the connecting members 7 from the slots 5*c* formed in the wall of the clutch drum 5 into engagement with the ridges 4*a* formed on the inside surface of the winding roll 2. Thus the rotation of the winding roll is prevented, so that the blind cloth is stopped at the desired position.

When it is desired to raise the blind cloth, the winding roll 2 is rotated in the direction A to rotate the clutch drum supporting member 4. Owing to the engagement of the ridges 4*a* and the connecting members 7, the clutch drum 5 is rotated in the direction A. The second clutch wheel 10 rotatable with the clutch frame 5*a* and the first clutch wheel 9 held in engagement with said second clutch wheel are rotated, so that the first clutch wheel 9 is rotated by an angle corresponding to one of the clutch dogs 6*b* formed on the bracket 6. Thus the blind cloth is prevented from further moving downward. Then the drawing of the blind cloth is ceased and the blind cloth is released. In such a situation the winding roll 2 is subjected to the rotating force in the direction B by the resilient force of the coil spring 3, so that the clutch frame 5*a* is rotated again in the direction B by an angle corresponding to one of the dogs. Since the clutch dogs 6*b* of the bracket 6 are held in engagement with the first clutch wheel 9, the rotation of the clutch frame 5*a* causes rotation of the second clutch wheel 10 in the direction B relatively to the first clutch wheel by an angle corresponding to one of the clutch dogs. Thus the relative position of the clutch shaft 8 and the clutch drum 5 connected to the second clutch wheel 10 is changed, whereby the connecting members 7 are retracted into the clutch drum 5. Accordingly, the winding roll 2 is disconnected from the clutch drum 5 and it is freely rotated under the action of the coil spring 3, thereby winding up the blind cloth thereon.

The speed reducing device 12 comprises a body fixed in the winding roll 2 and the center shaft 13 connected to the clutch drum, and it serves to smoothly wind up the blind cloth onto the winding roll.

Figure 4:
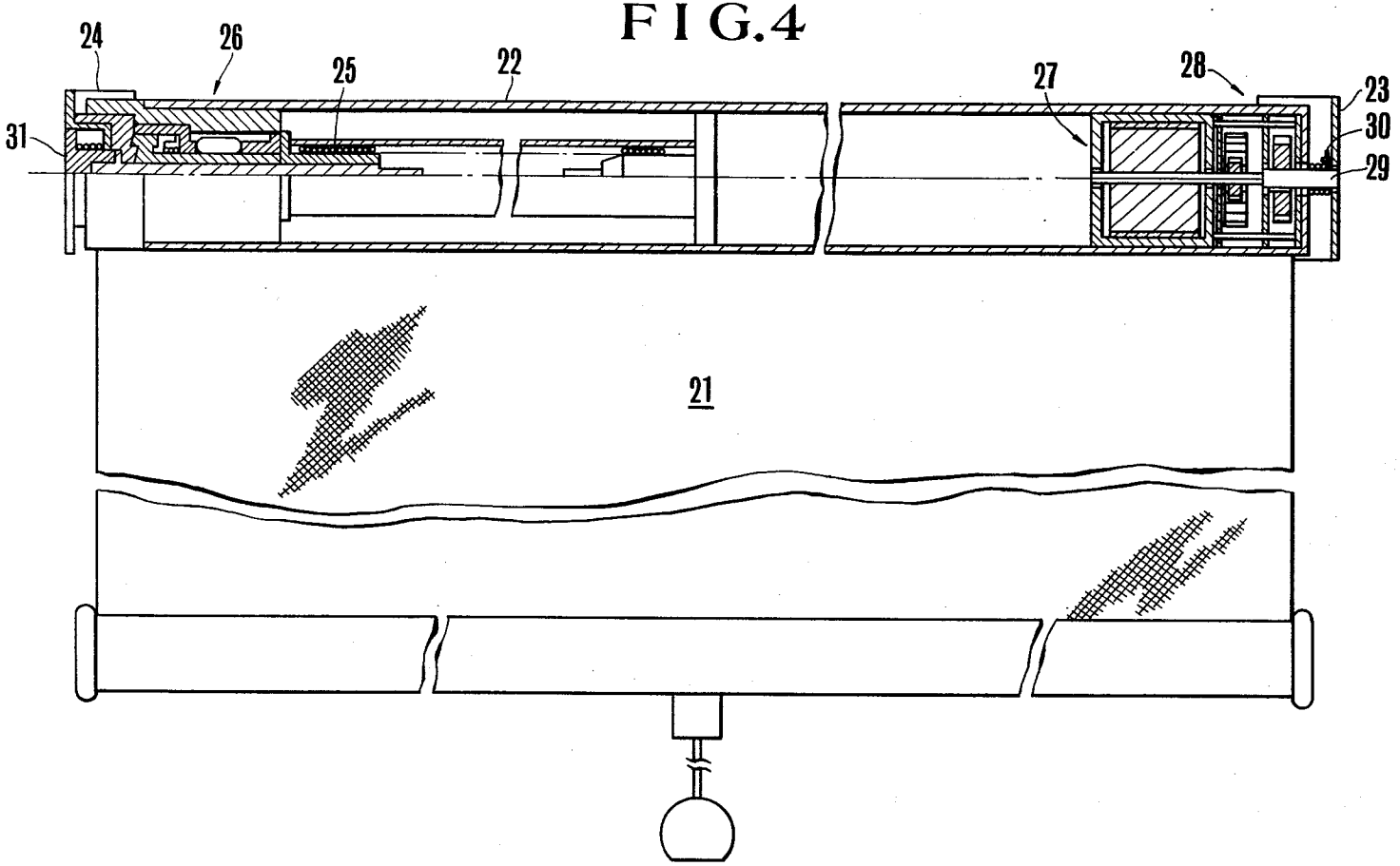
FIG. 4 is a longitudinal section showing another embodiment of the device according to the present invention.
Figure 5:
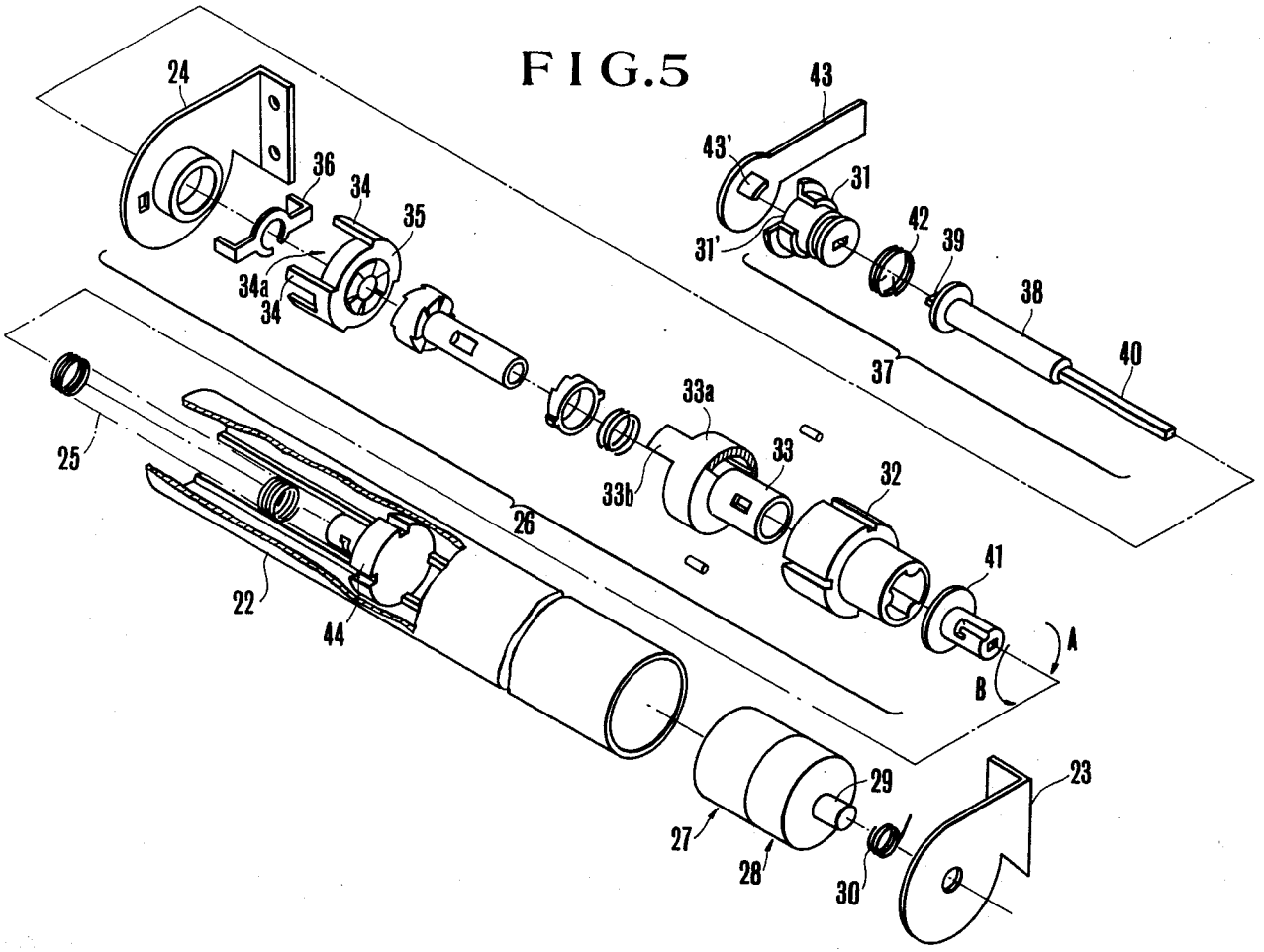
FIG. 5 is an exploded perspective view of the device shown in FIG. 4.
Figure 6:
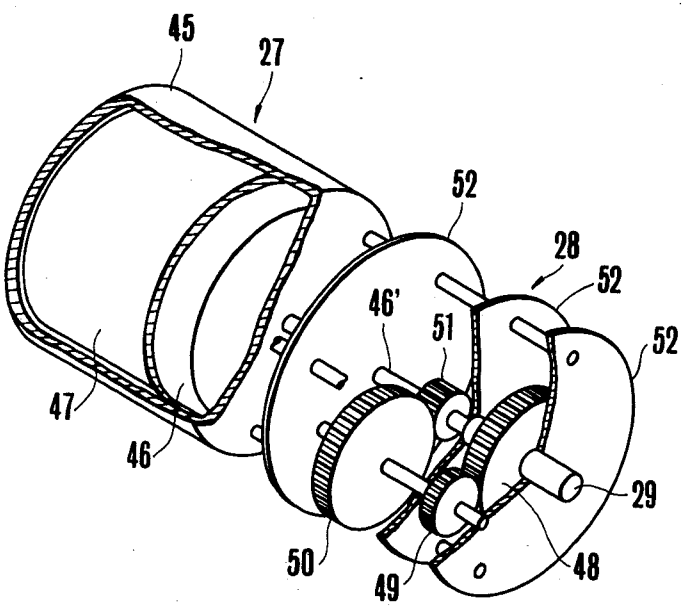
FIG. 6 is a perspective view, partly broken, of an oil damper device shown in FIG. 4.

FIGS. 4 to 6 illustrate another embodiment of the present invention. The roll blind shown in FIGS. 4 to 6 includes a blind cloth 21, a cloth winding roll 22, brackets 23 and 24, a coil spring 25 for constantly applying rotating force to said winding roll in the cloth winding-up direction, a blind driving and stopping device 26, an oil damper device 27 and a gearing device 28.

The winding roll 22 is supported at its one end on the bracket 23 by a center shaft 29, on which a one-way clutch spring 30 is arranged, and at its other end on the bracket 24 by a bearing member 31, to which one of the coil spring 25 is fixedly connected.

The device for driving and stopping the roll blind includes essentially same parts as those of the device shown in FIG. 3 and produces essentially same function as that of the latter. This device includes a clutch drum supporting member 32 and a clutch drum 33 which has a clutch frame **33*a*. The clutch frame 33*a* has projections 33*b* having arcuate shape in section, which engage in the spaces 34*a* between projections 34 formed on a clutch disc 35 which is fixedly mounted on the bracket 24 by means of a fixing member 36. Thus the clutch drum 33 is supported by the clutch disc 35 so that the former is rotatable to a predetermined angle relatively to the latter. The clutch drum 33 has same construction as that of the clutch drum 5 shown in FIG. 3**.

In FIG. 5, 37 indicates a device for energizing the coil spring 25. This device includes a center shaft 38, which projects at its one end 39 to the outside of the bracket 24 and is connected at its other end 40 to a coil spring fixing member 41. A one-way clutch spring 42 is arranged on the bearing member 31. 43 indicates an adjusting lever having a projection 43'. When adjusting the energization of the coil spring 25, the lever 43 is engaged at its projection to a recess 31' formed on the bearing member 31, and the above-mentioned one-way clutch spring 42 functions to permit the rotation of the bearing member in the spring energizing direction by the adjusting member does not permit the rotation from the winding roll. The coil spring 25 is connected at its one end to the fixing member 41 and at its other end to a fixing member 44 which is integrally formed in the winding roll 22.

The other parts in FIG. 5 are same as those shown in FIG. 3, and the operation of the device shown in FIG. 5 is substantially same as that of the device shown in FIG. 3.

The oil damper device 27 functions to produce smooth cloth winding-up operation at a constant speed. This device is not required to operate during the cloth lowering operation, and in order to cause the oil damper device to operate only during the cloth winding-up operation the one-way clutch spring 30 is arranged between the bracket 23 and the shaft 29. The clutch spring 30 permits free rotation of the shaft 29 in the cloth lowering direction, while it does not permit the rotation of the shaft 29 in the cloth raising direction.

An embodiment of the oil damper device is shown in FIG. 6. This device includes a cylindrical casing 45 fixed in the winding roll 22, a drum 46 and a damping oil (grease) 47 disposed between the roll and the drum. In order to promote the damping function of the oil damper device, the drum 46 is arranged to be rotated in the opposite direction to the casing 45. The shaft 46' of the drum 46, which is coaxial with but separate from the center shaft 29, is connected through the gearing device 28 to the center shaft 29. The gearing device 28 includes gears 48, 49, 50 and 51 supported by discs 52 fixedly connected to the casing 45.

By using the oil damper device, the winding-up operation of the blind cloth is effected smoothly at a constant speed, without producing substantial noise. Furthermore, the blind cloth is prevented from producing damage due to rapid cloth winding-up operation.

Figure 7:
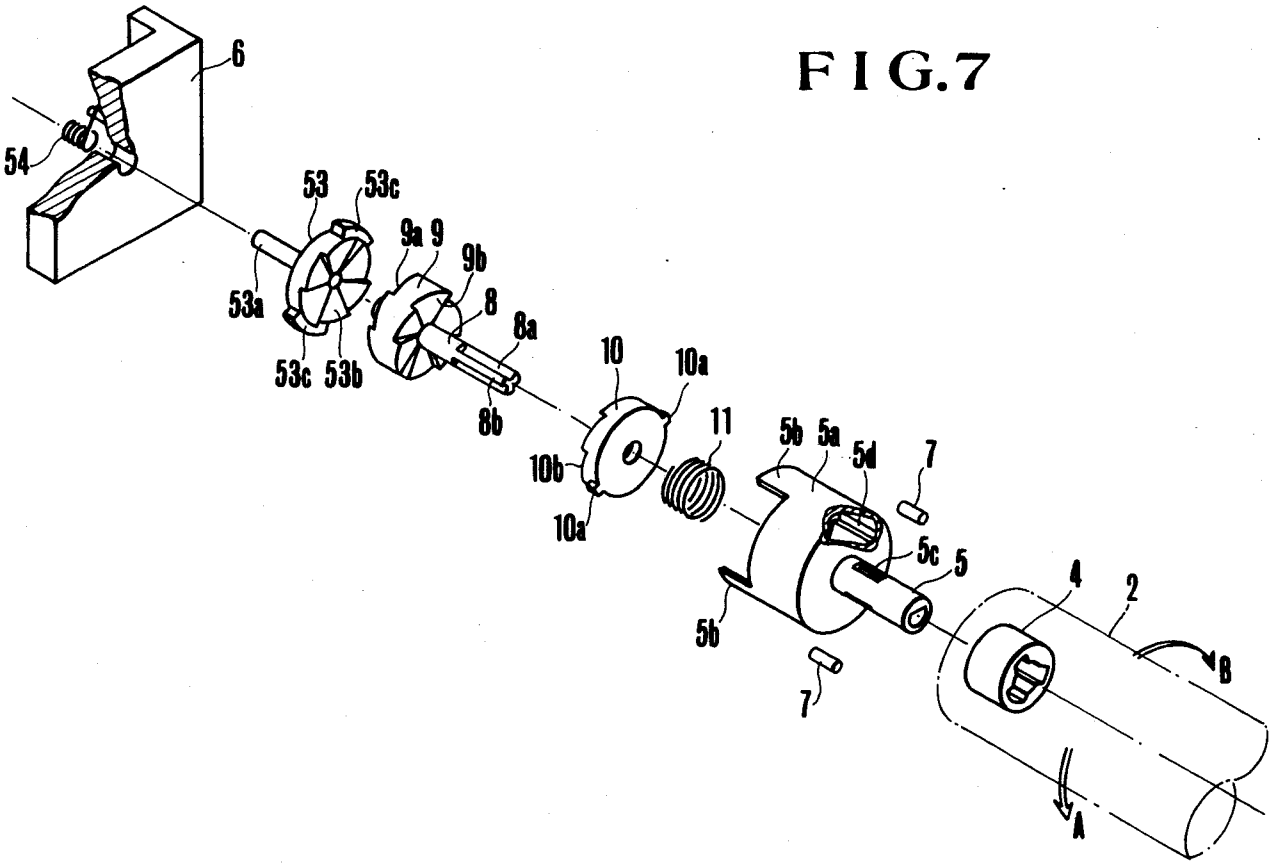
FIG. 7 is an exploded perspective view, showing a further embodiment of the device according to the present invention.

FIG. 7 illustrates another embodiment of the present invention. This embodiment is substantially the same as that shown in FIG. 3, with the only exception that a third clutch wheel 53 is arranged between the first clutch wheel 9 and the bracket 6; and therefore the same parts in FIG. 7 as those shown in FIG. 3 are indicated by the same numerals and the detailed descriptions thereof are omitted.

The third clutch wheel 53 has a shaft **53*a* rotatably supported by the bracket 6. A one-way clutch spring 54 is arranged between the bracket and the shaft to permit the rotation of the third clutch wheel only the blind lowering direction. The clutch wheel 53 has clutch dogs 53*b* which correspond to the clutch dogs 9*b* shown in FIG. 3. The clutch wheel 53 further includes projections 53*c*, to which the projections 5*b* of the clutch frame 5*a* of the clutch drum 5, so that the clutch drum 5 is rotatable to a predetermined angle relatively to the third clutch wheel 53**.

The operation of the device shown in FIG. 7 is substantially same as that of the device shown in FIG. 3, provided that the operation at the time of raising the blind cloth is different from each other. That is, in case of the device shown in FIG. 3, when the blind cloth is drawn downward from the stopped position in order to cause raising movement of the blind cloth, the blind cloth is stopped after it has moved downward by predetermined distance. If a strong force is applied to further move the blind cloth downward after it has been stopped, the blind cloth and/or clutch mechanism may be damaged.

On the other hand, in case of the device shown in FIG. 7, if a strong force is applied a further move the blind cloth downward, the third clutch wheel will permit such downward movement of the blind cloth, so that the damage of the cloth and/or clutch mechanism can be prevented.

It will be understood from the above explanation that the present invention provides a device for driving and stopping a roll blind in which a mechanism for stopping a blind cloth can be correctly changed to ON- and OFF-positions by repeating raising and lowering operation of the roll blind and the changing operation of the stopping mechanism is effected in reliable manner, so that the blind cloth can be stopped correctly at a desired position even by an unskilled person, thus providing considerable advantages in practical use.

What is claimed is:

1. A device for driving and stopping a roll blind including a blind cloth and a cloth winding roll for winding up or unwinding said blind cloth, said cloth winding roll having a coil spring for constantly applying rotating force to the cloth winding roll in cloth winding up direction and means for stopping said winding roll against the action of said coil spring to stop the blind cloth at a desired height, which comprises a clutch drum supporting member fixedly mounted in said winding roll in coaxial relation therewith, a clutch drum loosely fitted in said supporting member in coaxial relation therewith and rotatably supported at its one end on one of roll blind supporting brackets so that it can rotate at a perdetermined angle relatively to said bracket, a connecting member movably mounted in said clutch drum to project from said clutch drum to connect the supporting member with said clutch drum and retract in said clutch drum to disconnect the supporting member from the clutch drum, and a clutch mechanism for retracting said connecting member into the clutch drum to allow free rotation of said winding roll when the blind cloth is moved downward, then projecting said connecting member from the clutch drum when the downward movement of the blind cloth is stopped and retracting said connecting member into the clutch drum again when the blind cloth is slightly moved downward from said stopped position, the clutch mechanism comprises a clutch shaft rotatably mounted in said clutch drum for rotation to right and left within a predetermined angle to move said connecting member to its projected and retracted positions, a first clutch wheel integrally formed on said clutch shaft, a second clutch wheel loosely fitted on said clutch shaft for axial movement relative to said clutch drum and a spring for resiliently urging these clutch wheels together, said first clutch wheel and said one of roll blind supporting brackets being formed on their contacting surfaces with a number of clutch dogs which only allow the rotation of the first clutch wheel in the cloth descending direction, said first clutch wheel and said second clutch wheel being formed on their contacting surfaces with the same number of clutch dogs which only allow the transmission of the rotation of the second clutch wheel in said direction of the first clutch wheel.

2. A device for driving and stopping a roll blind according to claim 1, in which a speed reducing device is arranged between the clutch drum and the winding roll.

3. A device according to claim 1, in which an oil damper device is arranged between the winding roll and a shaft for supporting the roll.

* * * * *